United States Patent [19]

Fitch

[11] 3,987,850

[45] Oct. 26, 1976

[54] WELL COMPLETION METHOD FOR CONTROLLING SAND PRODUCTION

[75] Inventor: John L. Fitch, Dallas, Tex.

[73] Assignee: Mobil Oil Corporation, New York, N.Y.

[22] Filed: June 13, 1975

[21] Appl. No.: 586,843

[52] U.S. Cl. ..... 166/254; 166/247; 166/255; 166/280; 166/281

[51] Int. Cl.[2] ..... E21B 33/138; E21B 43/26; E21B 47/00

[58] Field of Search ..... 166/280, 276, 281, 292, 166/293–295, 308, 250, 247, 254, 255

[56] References Cited

UNITED STATES PATENTS

| | | | |
|---|---|---|---|
| 3,126,056 | 3/1964 | Harrell | 166/280 |
| 3,127,937 | 4/1964 | McGuire, Jr. et al. | 166/280 |
| 3,138,205 | 6/1964 | Kerver et al. | 166/280 |
| 3,155,159 | 11/1964 | McGuire, Jr. et al. | 166/280 |
| 3,241,613 | 3/1966 | Kern et al. | 166/280 |
| 3,285,335 | 11/1966 | Reistle, Jr. | 166/308 X |
| 3,343,600 | 9/1967 | Phansalkar et al. | 166/281 |
| 3,419,070 | 12/1968 | Ernst | 166/281 UX |
| 3,428,122 | 9/1969 | Methven et al. | 166/295 |
| 3,642,068 | 2/1972 | Fitch et al. | 166/308 X |
| 3,687,203 | 8/1972 | Malone | 166/308 |
| 3,708,013 | 1/1973 | Dismukes | 166/276 |
| 3,709,300 | 1/1973 | Pye | 166/280 |
| 3,796,883 | 3/1974 | Smith et al. | 166/250 X |
| 3,815,680 | 6/1974 | McGuire et al. | 166/281 |
| 3,818,990 | 6/1974 | Coulter | 166/280 |

OTHER PUBLICATIONS

Pirson, Sylvain J., "Oil Reservoir Engineering", 2d Ed., McGraw–Hill Book Co. Inc., N.Y., N.Y., 1958, p. 232.

*Primary Examiner*—Stephen J. Novosad
*Attorney, Agent, or Firm*—C. A. Huggett; Henry L. Ehrilich

[57] ABSTRACT

This specification discloses a method of completing a well that penetrates a subterranean formation. The formation is vertically fractured and a lower portion of the fracture is propped by hydraulic fracturing techniques leaving an overlying unpropped portion of the fracture. The well is treated to block the communication of the unpropped portion of the fracture with the well.

6 Claims, 1 Drawing Figure

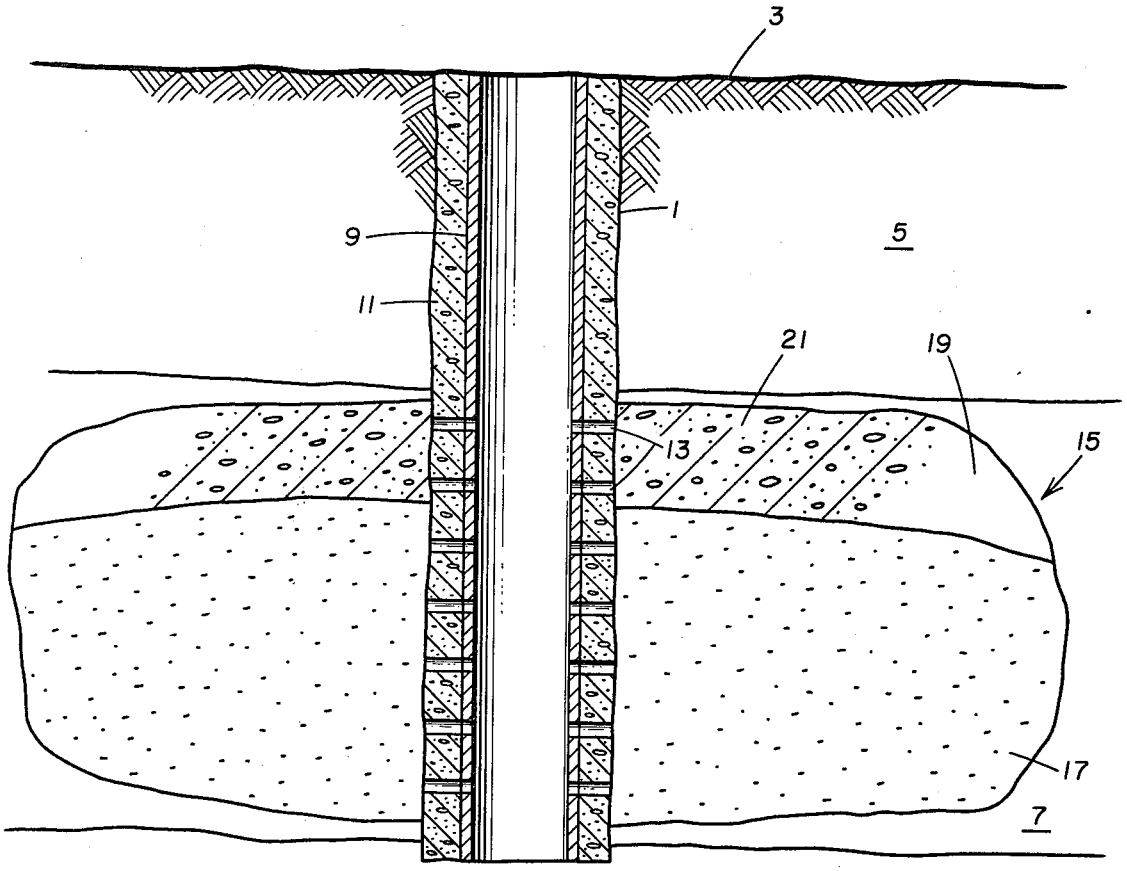
3
1
9
5
11
21
19
13
15
17
7

WELL COMPLETION METHOD FOR CONTROLLING SAND PRODUCTION

BACKGROUND OF THE INVENTION

This invention relates to a method of completing a well that penetrates a subterranean formation and more particularly relates to a method of controlling the production of sand from an unconsolidated hydrocarbon-bearing formation.

Hydraulic fracturing techniques are commonly employed in the completion of wells to enhance the recovery of hydrocarbons from subterranean hydrocarbon-bearing formations. In carrying out such techniques, a fracturing fluid is injected down a well and into contact with the formation to be fractured. Hydraulic pressure is applied via the fracturing fluid to fracture the formation and thereafter fracturing fluid is injected into the formation propagate the fracture thereinto. Propping material is usually included in the fracturing fluid to prop the fracture that is formed. It is commonly accepted that at depths greater than about 2000 to 3000 feet most formations have preferred vertical fracture orientations and fractures formed therein by hydraulic fracturing techniques are vertically disposed fractures.

In U. S. Pat. No. 3,642,068 there is disclosed a fracturing process wherein a fracture is formed in a formation, is acid etched near the well, and is particle propped in the more remote portions of the fracture. In U. S. Pat. No. 3,687,203 there is described a process wherein a fracture is initiated in a non-productive zone and is extended vertically upward into a producing zone. Propping material is injected into the fracture and settles in the bottom portion thereof and fills the fracture to some height less than the height of the fracture to hold open a portion of the fracture above the settled material. This open portion allows the part of the fracture in the producing zone to have infinite ability to conduct production flow from the formation into the wellbore. In U. S. pat. No. 3,126,056 there is described a method of propping and sealing a fracture in a petroleumproducing formation for preventing substantially undesirable water flow with the petroleum produced therefrom. A vertical fracture is formed and the lower part of the fracture is sealed to block the portion of the formation that is expected to produce undesirable quantities of water but not to block the portion of the formation from which petroleum is to be produced.

Hydrocarbons are many times found in subterranean unconsolidated formations. Such formations are normally poorly cemented sandstone formations which may in some instances have little or no cementing material holding the sand grains together.

The production of hydrocarbons from unconsolidated formations may result in the production of sand from the formation along with the hydrocarbons. The production of sand is undesirable for many reasons. It is abrasive to components within the well such as tubing, pumps, and valves and may partially or completely clog the well.

Various techniques have been used for controlling the flow of sand from unconsolifated formations. Many of these techniques employ the use of slotted or screened liners or gravel packs to prevent the sand from being transported along with the hydrocarbons into the well. Other techniques make use of consolidating plastic material to cement the grains together and thereby prevent caving. Still other techniques include hydraulic fracturing techniques wherein the unconsolidated formation is fractured and propping material is deposited in the fracture. The propping material in the fracture may be consolidated to improve the stability of the propped fracture.

In U. S. Pat. No. 3,138,205 there is described a method for fracturing a subsurface formation with a fracturing fluid containing a propping agent and consolidating the propping agent in the fractures to maintain the fracture propping agents in place. In U.S. Pat. No. 3,343,600 there is described a technique for simultaneously fracturing and consolidating a relatively, loose, weak or semi-consolidated subterranean oil- or gas- containing formation. The formation is fractured by injecting a fracturing fluid into the formation under sufficient pressure to fracture the formation and the fracture is propagated by continuing to inject fracturing fluid into the formation. A dilute solution of a plastic or resinous consolidating agent is circulated into the formation via the fracture to consolidate the formation surrounding and defining the fracture. A propping agent may also be injected into the fracture and consolidated therein. Other techniques for fracturing and propping unconsolidated subterranean formations are described in U. S. Pats. Nos. 3,428,122 and 3,815,680.

As previously mentioned, gravel-packing techniques are commonly employed for controlling the production of sand from unconsolidated formations. Such a technique is described in U. S. Pat. No. 3,708,013. In accordance with this technique, materials are flowed through casing perforations to provide a consolidated gravel pack adjacent a subsurface formation. Thereafter, further perforations are formed through the casing to extend into and terminate within the consolidated gravel pack. It is noted that in such a gravel pack the horizontal thickness thereof may be a minimum near the upper perforations because of the tendency for the granulated material to settled away from the upper extension of the cavity about the casing into which the pack is formed. Therefore, a packer may be set in the casing to seal the upper perforations and eliminate flow through those perforations adjacent the portion of the gravel pack having the least horizontal thickness, thereby eliminating the possibility that unconsolidated sands from the formation will be produced through those upper perforations into the casing.

In U. S. Pat. No. 3,796,883 the effectiveness and competency of a well gravel pack and changes therein are determined by monitoring the location of radioactive pellets within the gravel pack. The effectiveness of formation fracturing and the location and orientation of such fractures have also been ascertained by the use of radioactive logs. Such reservoir engineering techniques are discussed in OIL RESERVOIR ENGINEERING by Silvain J. Pirson, 1958, at page 232, where it is said that another reservoir engineering use of tracer studies in a well is to ascertain the effectiveness of formation fracturing and the location and orientation of such fractures. For this purpose the radioactive tracer is plated on part of the propping sand and is used as the last batch injected with the fracturing fluid. The logging procedure is the same as for permeability-profiling determination: conventional log, base log, first run after completion of injection, and continued logging at intervals to ascertain wash out of plating material.

SUMMARY OF THE INVENTION

This invention is directed to a method of completing a well that penetrates a subterranean formation. Fracturing fluid is injected down the well and into the formation to form therein a vertical fracture that communicates with the well and propping material is deposited in the fracture to form a propped vertical fracture that is overlain by an unpropped portion of the vertical fracture. The upper location of the propping material in the propped vertical fracture is determined and the well is treated above the upper location of the propping matrial to block the communication of the unpropped portion of the vertical fracture with the well.

BRIEF DESCRIPTION OF THE DRAWING

The drawing is a schematic view of a well extending into a subterranean formation and illustrating a vertical fracture in the formation propped in the lower portion thereof and sealed in the overlying unpropped portion thereof.

DESCRIPTION OF THE PREFERRED EMBODIMENTS

This invention is applicable to treating wells that penetrate subterranean hydrocarbon-bearing formations and in particular is applicable to controlling the production of sand from unconsolidated hydrocarbon-bearing formations.

In accordance with this invention, cased well is provided that extends from the surface of the earth and penetrates a subterranean formation. Openings are provided through the casing to provide fluid communication intermediate the well and the formation. A fracturing fluid is injected down the well and into communication with the formation and pressure is applied via the fracturing fluid to the formation to form and propagate into the formation a vertical or vertically disposed fracture. Propping material is entrained in the fracturing fluid and is deposited in the fracture to prop the fracture and form a propped portion that is overlain by an unpropped portion thereof. The upper location of the propping material in the propped vertical fracture is determined and the well is treated to block the fluid communication intermediate the unpropped portion of the vertical fracture and the well.

Referring to the drawing, there is shown a well 1 which extends from the surface of the earth 3 through an overburden 5 and penetrates a hydrocarbon-bearing subterranean formation 7. Casing 9 is shown positioned in the well 1 and held in place by a cement sheath 11. Perforations 13 extend through the casing 9 and cement sheath 11 to provide fluid communication intermediate the interior of the casing 9 and the subterranean formation 7. A vertical fracture 15 extends into the subterranean formation 7 and communicates via the perforations 13 with the interior of the casing 9. Propping material is provided in a lower portion of the vertical fracture 15 to form a propped portion 17 of the vertical fracture. Overlying this propped portion 17 is an unpropped portion 19 of the vertical fracture. Sealing material 21 is provided in the unpropped portion 19 of the vertical fracture to block the communication of the unpropped portion 19 with the interior of casing 9.

This invention may be used for treating wells that penetrate any subterranean hydrocarbon-bearing formation but is particularly applicable for treating wells that penetrate unconsolidated hydrocarbon-bearing formations to control the production of formation particles therefrom, hereafter referred to as "sand", and therefore will be described primarily with reference to treating unconsolidated formations.

With reference to the drawing for a more complete description of this invention, the vertical fracture 15 may be formed in a hydrocarbon-bearing unconsolidated formation 7 by conventional hydraulic fracturing techniques wherein propping material is entrained in the fracturing fluid to prop the formed vertical fracture. In carrying out hydraulic fracturing techniques, the propping material has a tendency to settle from the fracturing fluid and be deposited in a lower portion of the vertical fracture leaving an unpropped portion 19 of the vertical fracture 15 overlying the propped portion 17. Unconsolidated hydrocarbon-bearing formations have previously been treated in the manner described to control the production of sand therefrom. The propped portion 17 of the vertical fracture 15 serves to block the movement of sand from the unconsolidated formation 7 into the well 1. However, sand may move from the unconsolidated formation 7 through the unpropped portion 19 of the vertical fracture 15 and into well 1. Further, the propping material may flow into the unpropped portion 19 and thence into the well and thereby break down the propped portion 17 of the fracture, thus lessening or destroying the effectiveness of the sand control technique. Various techniques have been used to improve the above-described sand control technique. For example, consolidating material such as consolidating plastics have been injected into vertical fractures to consolidate the propping material in the fracture and to consolidate the walls of the fracture. Further, the remaining portion of the formation which communicates with the well has likewise been consolidated. Other techniques have been used to deposit propping material over the entire height of the vertical fracture. For example, it is common when carrying out such a technique of sand control to increase the concentration of the sand in the fracturing fluid near the end of the fracturing job until a "sand-out" occurs. This occurs when the formation no longer readily accepts the fracturing fluid and a rapid rise in the injection pressure is noted. However, none of these techniques has proven to be a complete solution to the sand control problem.

In accordance with a preferred embodiment, the upper level of the propping material in the vertical fracture is determined by radioactive logging the well. Desirably the propping material that is injected into the fracture is tagged with radioactive material and a radioactive log is thereafter run to determine the upper level of the propping material in the fracture. If desired only the last batch of the propping material injected into the fracture may be tagged with radioactive material.

A preferred method of blocking the communication of the unpropped portion of the fracture with the well is by injecting a sealing material into the unpropped portion and thereby sealing the communication of this unpropped portion with the well. A preferred sealing material is a cement slurry. Cement is readily available at well sites and cement slurries are commonly used in treating wells. Squeeze-cementing techniques may be employed to inject the cement slurry into the unpropped portion of the vertical fracture. In carrying out a squeeze-cementing technique a packer normally is set at or slightly below the upper level of the propping material in the fracture and the cement slurry forced down the well through tubing positioned therein and into the unpropped portion of the vertical fracture and there maintained and allowed to set.

In a preferred embodiment of this invention the preferred fracture orientation of the subterranean formation is determined. The preferred fracture orientation may be determined from measurements taken in wells that penetrate the formation. One method of determining the fracture orientation is by running an impression packer survey in a well that penetrates the formation. Borehole televiewer surveys offer a particularly good method of determining the preferred fracture orientation. Borehole televiewer surveys are discussed in an article by J. Zemanek, et al., entitled "The Borehole Televiewer - A New Logging Concept for Fracture Location and Other Types of Borehole Inspection," JOURNAL OF PETROLEUM TECHNOLOGY, Vol. XXI (June 1969), pp. 762–774. Knowing the preferred fracture orientation, the casing is opened to the formation essentially along a plane that parallels the preferred vertical fracture orientation. Normally the casing is opened by positioning a perforating device in the well to form perforations in the casing along this plane. Thereafter, fracturing fluid is injected into the formation through these perforations to form and propagate the vertical fracture into the formation. So aligning the perforations with the preferred fracture orientation aids in forming and extending a regular and uniform vertical fracture into the formation and avoiding the formation of a fracture having irregular and sharp bends. The formation of a regular and uniform fracture aids in propping the lower portion of the fracture and sealing the unpropped portion and thereby provides a more effective sand control technique.

I claim:

1. A method of completing a well that penetrates an unconsolidated hydrocarbon-bearing subterranean formation to control the production of formation particles therefrom, comprising the steps of:

a. injecting a fracturing fluid down said well and into said formation to form therein a vertical fracture that communicates with said well;

b. depositing propping material in said vertical fracture to form therein a propped portion of said vertical fracture and an overlying unpropped portion c. logging said well to determine the upper location of said propped portion of said vertical fracture;

d. injecting a sealing material via said well into said vertical fracture above said propped portion thereof to seal said unpropped portion of said vertical fracture from communication with said well and to maintain intact said propped portion of said vertical fracture; and e. producing hydrocarbons into said well from said formation via said intact propped portion of said vertical fracture to control the production of formation particles from said formation.

2. The method of claim 1 wherein a radioactive log is run to determine said upper location of said propping material in said vertical fracture.

3. A method of controlling the production of sand from an unconsolidated hydrocarbon-bearing formation that is penetrated by a well having casing therein, comprising:

a. forming openings through said casing to provide fluid communication intermediate said well and said formation;

b. injecting fracturing fluid and propping material via said well and said openings into said formation to form a vertical fracture therein having a propped portion and an overlying unpropped portion;

c. logging said well to determine the upper location of said propped portion of said vertical fracture;

d. injecting a sealing material via said well into said vertical fracture above said propped portion thereof to seal said unpropped portion of said vertical fracture from communication with said well and maintain intact said propped portion of said vertical fracture; and e. producing hydrocarbons into said well from said formation via said intact propped portion of said vertical fracture to control the production of formation particles from said formation.

4. The method of claim 3 wherein a radioactive log is run to determine said upper location of said propped portion of said vertical fracture.

5. The method of claim 4 wherein said sealing material is a cement slurry.

6. A method of controlling the production of sand from an unconsolidated hydrocarbon-bearing formation having a preferred vertical fracture orientation that is penetrated by a well having casing therein, comprising:

a. selectively opening said well to said formation by forming openings in said casing essentially only along a plane aligned with said preferred vertical fracture orientation;

b. injecting fracturing fluid and propping material via said well and said openings into said formation to form a vertical fracture therein having a propped portion and an overlying unpropped portion;

c. logging said well to determine the upper location of said propped portion of said vertical fracture;

d. injecting a sealing material via said well into said vertical fracture above said propped portion thereof to seal said unpropped portion of said vertical fracture from communication with said well and maintain intact said propped portion of said vertical fracture; and e. producing hydrocarbons into said well from said formation via said intact propped portion of said vertical fracture to control the production of formation particles from said formation.

* * * * *